US006119637A

United States Patent [19]

Matthews et al.

[11] Patent Number: 6,119,637

[45] Date of Patent: Sep. 19, 2000

[54] ON-BOARD GASOLINE DISTILLATION FOR REDUCED HYDROCARBON EMISSIONS AT START-UP

[75] Inventors: Ronald D. Matthews, Austin; Rudolf H. Stanglmaier, San Antonio, both of Tex.; George Carver Davis, Ypsilanti; Wengang Dai, Canton, both of Mich.

[73] Assignee: Ford Global Technologies, Inc., Dearborn, Mich.

[21] Appl. No.: 09/347,553

[22] Filed: Jul. 6, 1999

[51] Int. Cl.[7] ..... F02B 43/08

[52] U.S. Cl. ..... 123/3; 123/179.8; 123/576

[58] Field of Search ..... 123/575, 576, 123/578, 3, 179.8

[56] References Cited

U.S. PATENT DOCUMENTS

| | | | |
|---|---|---|---|
| 1,559,214 | 10/1925 | Woolson . | |
| 3,783,841 | 1/1974 | Hirschler . | |
| 3,794,000 | 2/1974 | Hodgkinson . | |
| 3,799,125 | 3/1974 | Hutchinson . | |
| 3,851,633 | 12/1974 | Shih | 123/576 |
| 3,963,013 | 6/1976 | Authement . | |
| 3,985,108 | 10/1976 | Matsumoto . | |
| 4,395,998 | 8/1983 | Chou . | |
| 5,357,908 | 10/1994 | Sung . | |
| 5,377,644 | 1/1995 | Krohm . | |
| 5,474,047 | 12/1995 | Cochard et al. | 123/576 |
| 5,524,582 | 6/1996 | Suh et al. | 123/576 |

FOREIGN PATENT DOCUMENTS

| | | | |
|---|---|---|---|
| 58-148245 | 9/1983 | Japan | 123/576 |

*Primary Examiner*—Erick R. Solis
*Attorney, Agent, or Firm*—Mark L. Mollon

[57] ABSTRACT

A gasoline distillation apparatus (12) for an engine (14) includes a heated vapor separator (22), a condenser (24), and a controller (28). The heated vapor separator (22) partially vaporizes the engine's primary fuel (16) to generate a fuel vapor (44). The condenser (24) cools the fuel vapor (44) to produce a liquid secondary fuel (18) that is more volatile than the primary fuel (16). The controller (28) determines when the engine (14) is supplied with either primary (16) or secondary fuel (18). The secondary fuel (18) is used only during an initial engine operation period, while the primary fuel (16) is used all other times. After engine operation, the primary fuel (16) is purged from the engine (14) and replaced with the secondary fuel (18) to maximize secondary fuel (18) use during the initial engine operation period.

20 Claims, 1 Drawing Sheet

ON-BOARD GASOLINE DISTILLATION FOR REDUCED HYDROCARBON EMISSIONS AT START-UP

TECHNICAL FIELD

The present invention relates generally to automotive fuel systems and more particularly to a device and method for on-board gasoline distillation for reduced hydrocarbon emissions at start-up.

BACKGROUND ART

The exhaust gas of internal combustion engines contains various amounts of unburned hydrocarbons, carbon monoxide and nitrogen oxides. Emission of these materials to the atmosphere is undesirable. The problem is more acute in urban areas having a high concentration of motor vehicles.

During recent years, researchers have investigated extensively means of reducing exhaust emissions. This research has been quite fruitful. As a result, present-day automobiles emit only a fraction of undesirable materials compared to those of less than a decade ago.

Despite the tremendous advances that have been made, further improvements are desirable. Federal standards continue to require reduction of emissions. A major obstacle in achieving further reduction in exhaust emissions is the fact that up to eighty percent of hydrocarbon emissions over the Federal Testing Procedure cycle are generated during the first 1–2 minutes of operation of a vehicle engine following a cold start.

There are several factors that contribute to excess hydrocarbon emissions at low engine temperatures. One of the primary functions is that the emission system catalyst does not achieve its optimum operating temperature until 1–2 minutes after a cold start and thus it is incapable of oxidizing all of the unburned fuel. This problem is exacerbated as a result of significant over-fueling because of the difficulty in vaporizing a sufficient fraction of the fuel to achieve stable combustion below 30° Celsius.

In the past, attempts have been made to eliminate the need for a warm-up period by operating the engine on liquid petroleum gas, or other secondary fuels, during the warm-up period and then switching to gasoline after an operating temperature is obtained. The concept was used, for example, on tractors and other machinery. These devices had a separate fuel tank that was filled with a second type of fuel different from the fuel in the main tank. The fuel supply was then selected with a manually operated petcock valve.

Due to the difficulties and impracticalities of using two separate fuels and two fuel source systems, other systems were developed which separated a single fuel into two components, one being more volatile than the other one. Systems of this type are shown, for example, in U.S. Pat. Nos. 5,357,908, 3,783,841, and 3,794,000.

The systems disclosed in these references, however, still had limitations, including the initial use of the primary fuel remaining in the fuel line at start-up, undesirable delays in starting the engine, the need for additional pressurization and heating systems, and/or the use of complicated and expensive components. Therefore, there is a need for a less complicated and less expensive system that separates fuel into various components, provides an improved air-fuel mixture at engine start-up, and, as a result, reduces hydrocarbon emissions.

SUMMARY OF THE INVENTION

It is an object of the invention to provide an improved and reliable means for on-board gasoline distillation. Another object of the invention is to provide an improved air-fuel mixture at engine startup. An additional object of the invention is to reduce hydrocarbon emissions.

In one aspect of the invention, a gasoline distillation apparatus for an engine includes a heated vapor separator, a condenser, and a controller. The heated vapor separator partially vaporizes the engine's primary fuel to generate a fuel vapor. The condenser cools the fuel vapor to produce a liquid secondary fuel that is more volatile than the primary fuel. The controller determines when the engine is to be supplied with either the primary or secondary fuel. The secondary fuel is used during an initial engine operation period and the primary fuel is used during normal operation. After the engine operation is terminated, the controller also purges the primary fuel from the engine and replaces it with the secondary fuel to maximize the use of secondary fuel during the initial engine operation period.

The present invention achieves an improved and reliable means for on-board gasoline distillation. Because the secondary fuel is more volatile than the primary fuel, it vaporizes at a lower temperature, which allows the use of an improved leaner fuel/air mixture when the engine is cold during start-up. A leaner fuel/air mixture results in reduced hydrocarbon emissions in the engine's exhaust. Also, the present invention is advantageous in that it will also overcome the cold weather starting and driveability problems of gasoline and alcohol-fuel vehicles.

Additional advantages and features of the present invention will become apparent from the description that follows, and may be realized by means of the instrumentalities and combinations particularly pointed out in the appended claims, taken in conjunction with the accompanying drawings.

BRIEF DESCRIPTION OF THE DRAWINGS

In order that the invention may be well understood, there will now be described some embodiments thereof, given by way of example, reference being made to the accompanying drawings, in which.

BEST MODE(S) FOR CARRYING OUT THE INVENTION

Figure 1:
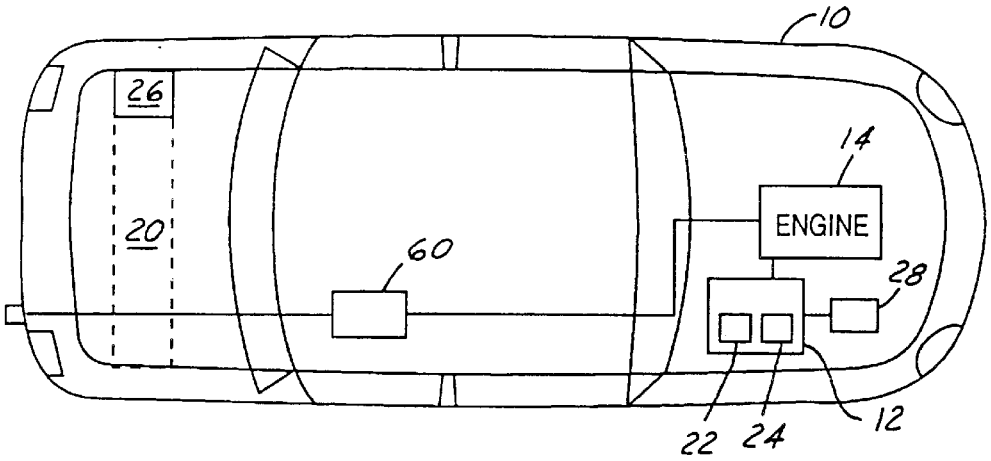
FIG. 1 is a perspective view of a vehicle having an on-board gasoline distillation apparatus in accordance with the present invention.

Referring to FIG. 1, a perspective view of a vehicle 10 having an on-board gasoline distillation apparatus 12 in accordance with the present invention is illustrated. Gasoline distillation apparatus 12 is located in vehicle 10 and supplies primary and secondary fuel to engine 14.

Figure 2:
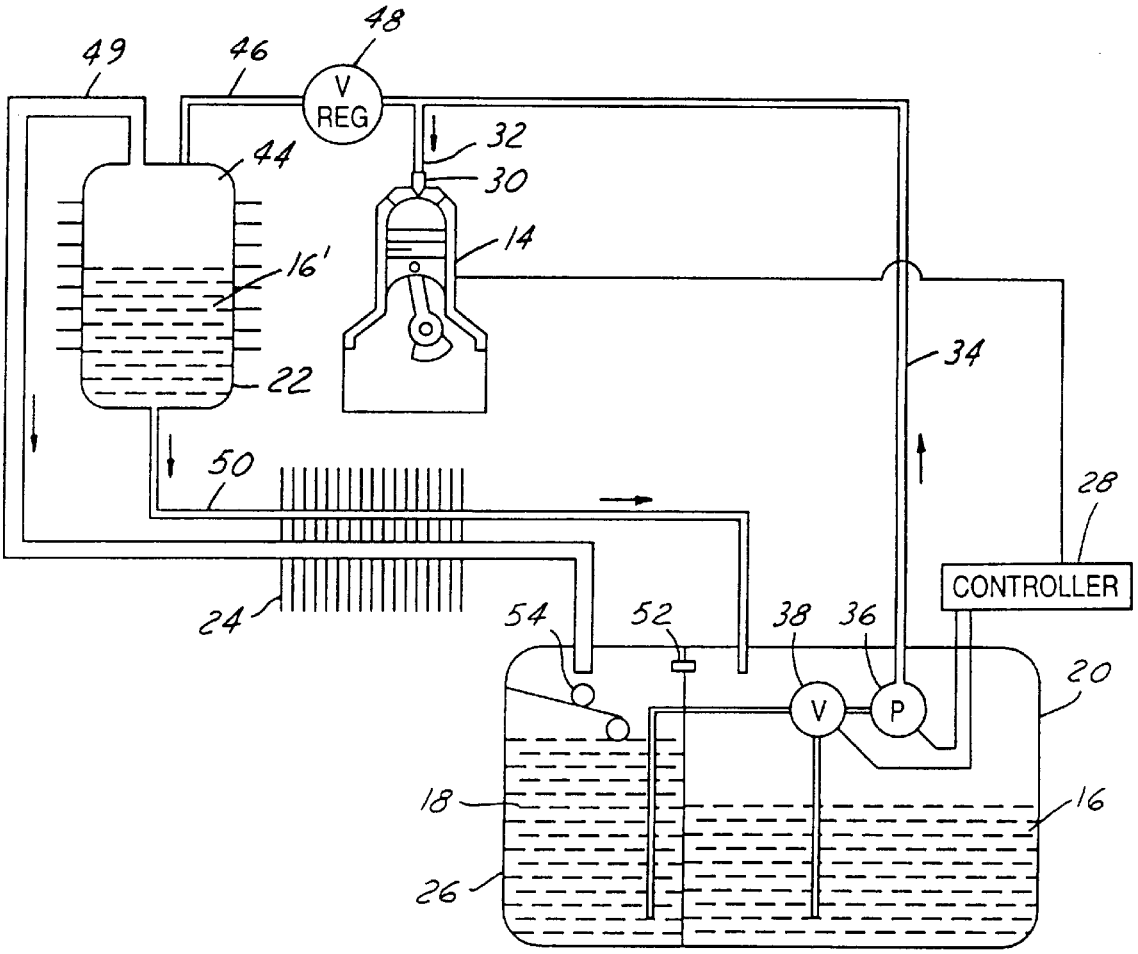
FIG. 2 is a schematic diagram of an on-board gasoline distillation apparatus in accordance with the present invention.

Referring to FIG. 2, a schematic diagram of an on-board gasoline distillation apparatus 12 in accordance with the present invention is illustrated. The gasoline distillation apparatus 12 includes a primary fuel tank 20, a vapor separator 22, a condenser 24, a secondary fuel tank 26, and a controller 28. The engine 14 includes a coolant system (not shown) which circulates a liquid coolant material through the engine to keep it within a certain operating temperature range. The engine also includes at least one fuel injector 30 coupled to a fuel rail 32, both of which are mounted on engine 14.

Primary fuel tank 20 is located in vehicle 10 and supplies a source of primary fuel 16 (such as gasoline) to the engine 14. Fuel flow is provided by a supply fuel line 34, which extends from primary fuel tank 20 to fuel rail 32, and a fuel pump 36. A three-way valve 38 is also mounted in the primary fuel tank 20 and is disposed in supply fuel line 34 downstream from the pump 36. The valve 38 is adapted to select between a primary suction line 40 in the primary fuel tank and a secondary suction line in the secondary fuel tank 42. Primary suction line 40 is coupled to the three-way valve 38 and extends into the primary fuel 16. Secondary suction line 42 is also coupled to the three-way valve 38 and extends into the secondary fuel 18. Preferably, the pump 36 and three-way valve 38 are combined into a single integrated electrically operated unit.

Vapor separator 22 is located in vehicle 10 in close proximity to the engine 14 and is a combination of a fuel vaporizer and a vapor/liquid separator. Primary fuel 16 is supplied to vapor separator 22 through a pressure regulator 48 and an overflow fuel line 46. The pressure regulator 48 is disposed in the supply fuel line 34 upstream from fuel rail 32 and maintains supply fuel line pressure.

The vapor separator 22 heats a quantity of primary fuel 16' to generate a fuel vapor 44. The fuel vapor 44 is removed from vapor separator 22 by a secondary return line 49, which extends from vapor separator 22 to the secondary fuel tank 26. Additional primary fuel 16' is removed from vapor separator 22 by a primary return line 50, which extends from vapor separator 22 to the primary fuel tank 20. Preferably, vapor separator 22 is heated to a temperature between 60° Celsius and 95° Celsius through heat exchange with the engine coolant. However, vapor separator 22 may also be positioned in close proximity with the engine 14 such that it is heated to a temperature between 60° Celsius and 80° Celsius through heat exchange from the engine.

The condenser 24 is also located in the vehicle 10 and cools the fuel vapor 44 to produce a supply of secondary fuel 18. The condenser 24 is disposed in the secondary return line 49. Preferably, the condenser 24 also cools the primary fuel 16' as it is being returned to the main or primary fuel tank 20.

The secondary fuel tank 26 is located in vehicle 10 and is preferably coupled to the main fuel tank 20. The secondary fuel tank 26 stores a supply of secondary fuel 18 so it can be supplied to the engine when needed. Due to the distillation process, the secondary fuel 18 is comprised primarily of the lighter and more volative components of the primary fuel 16. These components are easier to ignite and burn more completely than the heavier and less volative components in the fuel supply.

A vent 52 is mounted in the secondary fuel tank 26 to prevent unnecessary pressurization. A float valve 54 is also mounted in the secondary fuel tank 26 to terminate the flow of secondary fuel into the secondary fuel tank 26 when it is full and prevent overflow.

The controller 28 is located in the vehicle 10 and is coupled to the engine 14, pump 36, and three-way valve 38. The controller 28 regulates the flow of primary fuel 16 and secondary fuel 18 to the engine. In this regard, the secondary fuel 18 is used in the engine only during an initial engine operation period, preferably the first 30–120 seconds of operation. The primary fuel 16 is used during all other operation of the engine. Also, after the engine has finished operation (i.e., turned off), the primary fuel 16 is drained (or "purged") from the supply line 24 and fuel rail 32 and is replaced by the secondary fuel 18. Preferably this occurs when the engine coolant drops below approximately 45° Celsius.

During normal operation, the three-way valve 38 allows primary fuel 16 to flow through the primary suction line 40 to the fuel pump 36. Pump 36 supplies fuel rail 32 with primary fuel 16 through supply fuel line 34. Pressure regulator 48 allows the fuel pump 36 to pressurize both the supply fuel line 34 and the fuel rail 32 in order to allow proper operation of the fuel injectors 30 on the engine. Because pump 36 supplies more fuel than is required by the fuel injectors, there will be surplus primary fuel 16. The surplus primary fuel 16 is then carried away by the overflow fuel line 46 to the vapor separator 22.

Because the surplus primary fuel 16 is in close proximity to the engine, it will be slightly heated as it passes through to fuel line 46. The vapor separator 22 continues the heating process of the fuel and separates the more volatile components into a fuel vapor 44. The remaining primary fuel 16' is returned to the primary fuel tank 20 via the primary return line 50. The more volatile fuel vapor 44 is then passed through secondary fuel return line 49, cooled by condenser 24 to its liquid state and returned to secondary fuel tank 26. This results in a supply of secondary fuel 18 in tank 26 with more volatility than the primary fuel 16.

During an initial engine operation period, i.e. start-up or the first 30–120 seconds of operation, three-way valve 38 via controller 28 allows secondary fuel 18 to flow through secondary suction line 42 to pump 36. The pump 36 then supplies the fuel rail 32 with this secondary fuel 18 through supply fuel line 34. After the completion of this initial start-up period, the controller activates the three-way valve 38 and changes the flow of fuel to the engine from the secondary fuel to the primary fuel. At this point, the engine and catalytic converter 60 have been warmed up sufficiently to reach their normal operating temperatures.

After the vehicle engine has been turned off and ceased operation, the controller activates the three-way valve 38 and pump 36 to purge the supply fuel line 34 and fuel rail 32 of all remaining primary fuel 16. Preferably, the controller is programmed to accomplish this when the temperature of the coolant in the engine has dropped below approximately 45° Celsius. The three-way valve 38 and pump 36 then fill the supply fuel line 34 and fuel rail 32 with secondary fuel 18. In this manner, the engine 14 will begin its next cycle of operation using an initial supply of higher volatility secondary fuel 18.

The present invention achieves an improved and reliable means for on-board gasoline distillation. Specifically, it allows the use of an improved leaner fuel/air mixture during engine start-up. This improved leaner fuel/air mixture results in reduced hydrocarbon emissions in the engine's exhaust.

From the foregoing, it can be seen that there has been brought to the art a new and improved device and method for on-board gasoline distillation. It is to be understood that the preceding description of the preferred embodiment is merely illustrative of some of the many specific embodiments that represent applications of the principles of the present invention. Clearly, numerous and other arrangements would be evident to those skilled in the art without departing from the scope of the invention as defined by the following claims:

What is claimed is:

1. A gasoline distillation apparatus for an engine, said engine having a fuel intake, coolant, a primary fuel tank for storing a supply of primary fuel and a fuel transfer means including a fuel pump and a supply fuel line connecting the primary fuel tank with said engine for transferring the primary fuel to said engine, said gasoline distillation apparatus comprising:

a heated vapor separator for partially vaporizing said primary fuel to separate fuel vapor from said primary fuel;

a condenser for condensing said fuel vapor into a secondary fuel; and a controller for supplying primary fuel and secondary fuel to said engine, said controller, during a post engine operation period, purging primary fuel from said engine and filling said supply fuel line with secondary fuel before a next engine operation period, whereby said supply fuel line does not have to be filled when said engine is restarted, and said controller, during an initial engine operation period, supplying secondary fuel to said engine.

2. The apparatus as recited in claim 1 further comprising a secondary fuel tank wherein said secondary fuel is stored.

3. The apparatus as recited in claim 2 further comprising a vent in said secondary fuel tank.

4. The apparatus as recited in claim 2 wherein said secondary fuel tank is connected to and in communication with said primary fuel tank.

5. The apparatus as recited in claim 1 wherein said vapor separator is heated to a temperature between 60° Celsius and 95° Celsius through heat exchange with said coolant from said engine.

6. The apparatus as recited in claim 1 wherein said vapor separator is positioned in close proximity to said engine such that said vapor separator is heated to a temperature between 60° Celsius and 80° Celsius through heat exchange from said engine.

7. The apparatus as recited in claim 1 further comprising at least one fuel injector mounted on said engine and in liquid communication with said supply fuel line.

8. The apparatus as recited in claim 1 further comprising an overflow fuel line, said overflow fuel line supplying primary fuel to said vapor separator.

9. An apparatus as recited in claim 8 further comprising a secondary fuel return line and a secondary fuel tank, said secondary fuel return line connecting said vapor separator in liquid flow communication with said secondary fuel tank.

10. The apparatus as recited in claim 1 wherein said initial engine operating period is in the range from 30 to 120 seconds.

11. The apparatus as recited in claim 1 wherein said post engine operation period begins when the temperature of said coolant is less then approximately 45° Celsius.

12. A method of reducing hydrocarbon emissions in the exhaust gas discharged from an engine having coolant and fueled by a primary fuel, the method comprising the steps of:

supplying a portion of said primary fuel to a vapor separator;

distilling said primary fuel to generate a secondary fuel;

supplying said secondary fuel to said engine as part of a first fuel/air mixture during an initial engine operation period;

terminating the supply of said secondary fuel to said engine after said initial engine operation period;

supplying said primary fuel to said engine through a supply fuel line from a primary fuel tank as part of a second fuel/air mixture after said initial engine start-up period;

purging said primary fuel from said supply fuel line during a post engine operation period; and filling said supply fuel line with said secondary fuel during said post engine operation period before a next engine operation period, whereby said supply fuel line does not have to be filled when said engine is restarted.

13. The method as recited in claim 12 further comprising the step of storing said secondary fuel in a secondary fuel tank.

14. The method as recited in claim 13 further comprising the step of venting said secondary fuel tank.

15. The method as recited in claim 12 wherein the step of heating said primary fuel comprises heating said primary fuel to a temperature between 60° Celsius and 95° Celsius through heat exchange with engine coolant from said engine.

16. The method as recited in claim 12 wherein the step of heating said primary fuel comprises heating said primary fuel to a temperature between 60° Celsius and 80° Celsius through heat exchange from proximity with said engine.

17. The method as recited in claim 12 wherein said secondary fuel is supplied to said engine by said supply fuel line.

18. The method as recited in claim 12 wherein said primary fuel is supplied to said vapor separator by an overflow fuel line.

19. The method as recited in claim 12 wherein said post engine operation period initiates when the temperature of said coolant in said engine is less than about 45° Celsius.

20. The method as recited in claim 12 wherein said initial engine operation period ranges between 30 to 120 seconds.

* * * * *